United States Patent [19]

Eckberg, II

[11] 4,270,292

[45] Jun. 2, 1981

[54] SIGN WITH CHANGEABLE INSERTS

[75] Inventor: Keith S. Eckberg, II, St. Louis County, Mo.

[73] Assignee: Stout Industries, Inc., St. Louis, Mo.

[21] Appl. No.: 138,227

[22] Filed: Apr. 7, 1980

[51] Int. Cl.[3] ..... G09F 7/02

[52] U.S. Cl. ..... 40/611; 40/5; 40/618

[58] Field of Search ..... 40/5, 618, 620, 611

[56] References Cited

U.S. PATENT DOCUMENTS

| | | | |
|---|---|---|---|
| 1,840,193 | 1/1932 | Feldman et al. | 40/5 |
| 1,850,362 | 3/1932 | Vogel | 40/5 |
| 3,074,193 | 1/1963 | Munson | 40/5 |
| 3,583,630 | 11/1970 | De Korte et al. | 40/5 |

*Primary Examiner*—Gene Mancene

*Assistant Examiner*—Wenceslao J: Contreras

*Attorney, Agent, or Firm*—Kalish & Gilster

[57] ABSTRACT

A sign for carrying changeable inserts having a metal base plate of resilient material on which are formed a plurality of clips providing gripping engagement of an insert of sheet material to carry said insert removable upon a surface of the base plate. The clips each have a tab integral with the base plate. The tabs each extend above the surface and open onto said surface. Each tab resiliently bears against marginal portions of the insert sheet material for gripping engagement thereof. Said tabs are joined to the base plate by a zone of merger having compound curvature for nonlinear distribution of bending forces upon bending of said tab. Dimples upon opposite sides of each clip coact with the tab for providing more secure engagement of the insert.

10 Claims, 6 Drawing Figures

FIG. 1
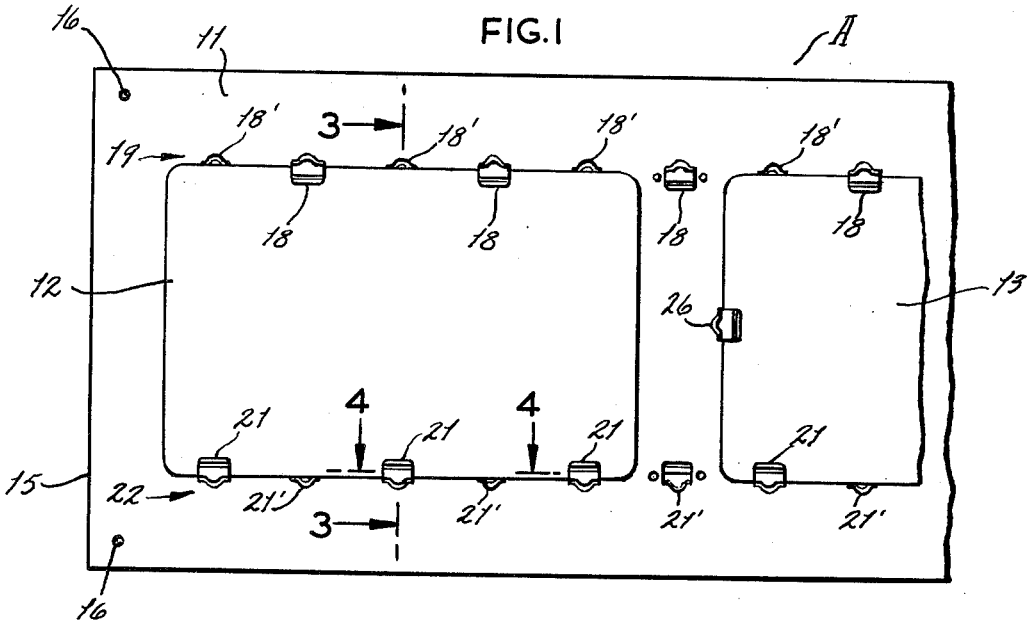
FIG. 2
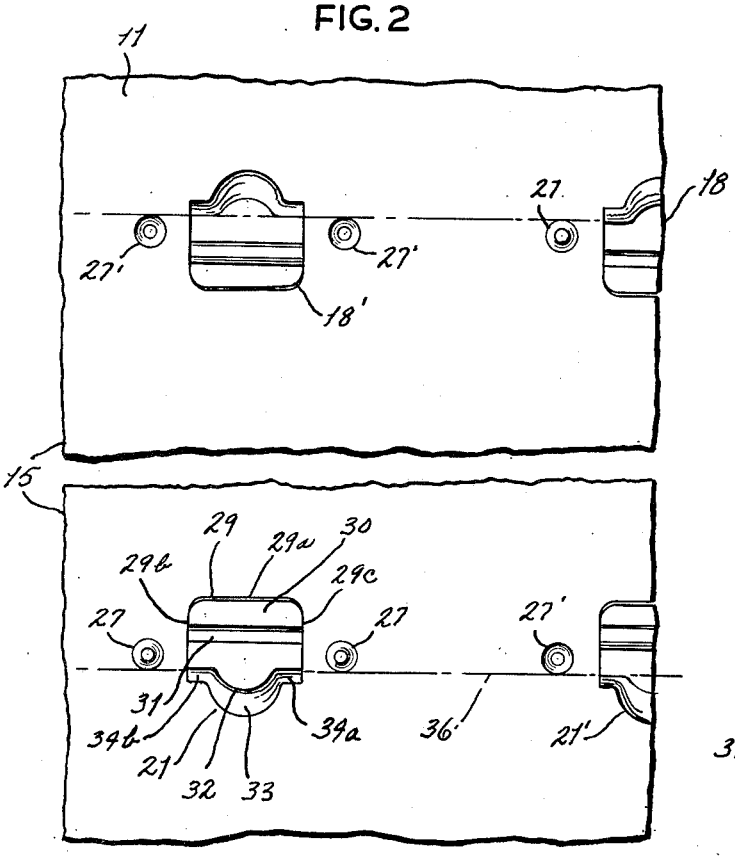
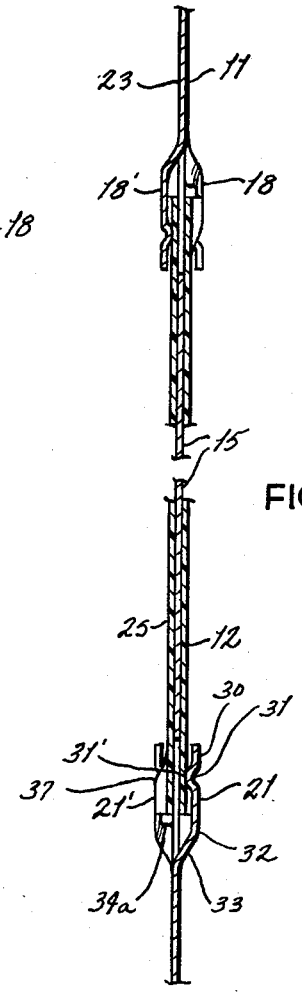
FIG. 3

SIGN WITH CHANGEABLE INSERTS

BACKGROUND OF THE INVENTION

This invention relates to improvements in signs and, more particularly, to signs carrying changeable panels, or so-called inserts.

Ubiquitous are signs of the type having slots, channels or tabs for carrying panels, or so-called inserts which are changeable to permit display of different indicia, such as price numerals, alphabetic characters, words, symbols or designs. Myriad applications call for the capability of such changeability. For example, motor fuel price signs must be capable of displaying different prices, where one or two digits of the price per gallon or liter may be subject to variation at any time.

Further, it may be desirable to change the entire character of a display. For example, if the fuel allotment for a filling station is sold out, the operation may wish to replace the inserts to change from a price display to a message such as "OUT OF GAS." Or, the operator may wish to advertise other products or services. Thus, he may wish to change the display from fuel price to "TIRE SALE," for example, by use of different inserts.

When signs of the foregoing type are used outside where exposed to various elements such as ice, rain, snow and high winds, it is important that the changeable inserts be very securely retained. Otherwise, they may become detached from the sign and be lost.

Heretofore, signs have been constructed having upset metal tabs formed in a metal base sheet, as by being struck by tooling, to engage the margin of such a sign insert. But a problem has been noted of insecure retention of the insert. Further, if the tab is required to resiliently engage the insert so that the tab will flex, the flexing ultimately may cause fatigue fracture of the tab, which then breaks off. This meets with poor commercial acceptance.

SUMMARY OF THE INVENTION

It is an object of the present invention to provide an improved sign for carrying so-called inserts of changeable character.

Another object of the invention is the provision of such a sign permitting the inserts to be readily and easily changed or replaced for a myriad of display purposes.

A further object of the invention is the provision of such a sign which tightly and securely retains the inserts upon the face of the sign even under various severe conditions, such as if outside where the sign is exposed to the environment.

A still further object of the invention is the provision of such a sign employing integrally formed clips of an improved character.

Another object of the invention is the provision of such a sign of the character stated having such clips which are not prone to breakage in use.

Among still other objects of the invention are the provision of such a sign which can reliably retain inserts of different sizes, different shapes, different materials and different thicknesses, including unusual, novel and striking geometric configurations; and which is low in manufacturing costs, simple in construction, and of durable, long-lasting character.

Other objects and features will be in part apparent and in part pointed out hereinbelow.

BRIEF DESCRIPTION OF THE DRAWINGS

FIG. 1 is a fragmentary plan view of a sign constructed in accordance with and embodying the present invention.

FIG. 2 is an enlarged plan view of portions of the sign of FIG. 1.

FIG. 3 is an enlarged vertical transverse cross-section of the sign taken along line 3—3 of FIG. 1.

Corresponding reference characters indicate corresponding elements throughout the several views of the drawings.

DESCRIPTION OF THE PREFERRED EMBODIMENTS

Figure 4:
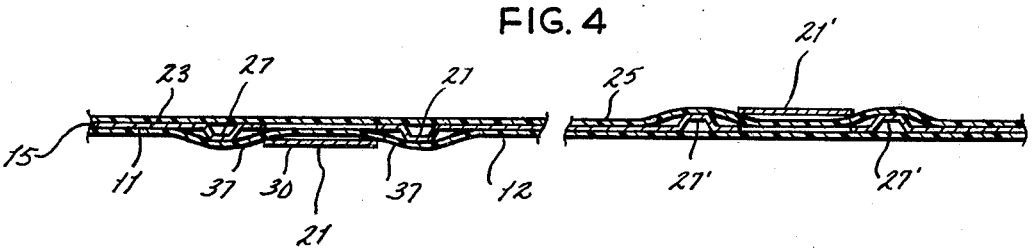
FIG. 4 is an enlarged horizontal transverse cross-section of the sign taken along line 4—4 of FIG. 1.

Referring now by reference characters to the drawings, and particularly to FIG. 1, designated generally as A is a first embodiment of the new sign of the invention, which is adapted for securely engaging and retaining in place on front face 11 of the sign a plurality of panels 12, 13 carrying various indicia thereon, such as numerals, alphabetic characters, symbols, designs, colors, etc. Said panels 12, 13, which are hereinafter referred to as inserts, are changeable. Sign A is adapted to permit removal and replacement of such inserts 12, 13 with others, as for changing the display of price, etc.

Sign A comprises a base plate 15 of thin, metal sheet material, such as, most preferably, aluminum alloy of, for example, 0.040 inch thickness. But other strong, thin metals such as painted, coated, plated or treated steel or stainless steel could be utilized, of suitable thickness. In any event, it is desired that the material forming base plate 15 be of relative strength and exhibit a degree of resilience and low ductility, while nevertheless being deformable for the purpose of permitting certain portions thereof, as explained to be upset by striking with die tooling.

Sign A is shown as being of a generally rectangular character but it is not intended to limit the sign to such shape, nor to limit the edges thereof to the rectilinear configuration shown. The sign is adapted for being mounted or secured to various structures. For this purpose, apertures as at 16 may be provided, although the sign base plate 15 may be carried by a frame or other means.

Provided upon front face 11 of sign A are rows of clips 18, 18' defining an upper row 19, as well as clips 21, 21' defining a lower row 22. All said clips are formed from upset portions of base plate 11 and have a special configuration, described below more specifically, according to the invention. However, clips 18, 18' of upper row 19 and clips 21, 21' of lower 22 are formed such that they alternate in terms of opening at the front face 11 of base plate 15 or its rear face 23. Thus, clips 18 each open downwardly at front face 11, while clips 21 open upwardly at front face. Similarly, clips 18', alternating with clips 18, each open downwardly at rear face 23, and clips 21', alternating with clips 21, each open upwardly at rear face 23.

The clips are all adapted for resiliently receiving and securely retaining marginal portions of the inserts, such as those illustrated at 12, 13 upon front face 11. Similar inserts, or panels, can thus also be retained upon rear face 15, such as the panel designated at 25.

The foregoing is not intended to suggest that the clips must be oriented only for engaging top and bottom margins of inserts. The clips can be arranged in vertical rows or otherwise located, such as the clip shown at 26 for engaging a side margin of an insert.

Referring to FIGS. 2, 3 and 4, the specific configuration of each of the clips is more clearly revealed. Additionally, there are seen to be provided sets of circular protrusions 27, 27' formed by dimpling of the base sheet. Such dimples 27, 27' are associated with each clip, there being a pair of dimples 27 extending outwardly from front face 11 on opposite sides of each of the front face-opening clips 18, 21 and 26. Similarly pairs of dimples 27' extend outwardly from rear face 25 on opposite sides of each of the rear face-opening clips 18', 21'.

The specific features of the clip-and-dimple arrangement may be appreciated by reference to a single one of the clips, such as that designated at 21 in FIG. 2, such being representative of other clips of the sign. Clip 21 is formed by upsetting the metal base sheet 15 along a foreshortened U-shaped line 29 of separation which is, of course, inverted for clip 21. Said line 29 has relatively long central portion **29*a* and shorter side portions 29*b*, 29*c* perpendicular to central portion 29*a* but joining same at rounded corners. Thus, there is formed a tab 30 of generally rectangular character. Said tab is essentially offset from the plane of sheet 15 by a small distance, such as about 0.1 inch dependent upon and greater than the thickness of the insert, and with the tab being generally parallel to surface 11**.

Further, tab 30 is struck with recurvature defining a rectilinear indentation 31 extending transversely across the width of the tab, whereby there is defined a corresponding elongated protrusion 31' on the opposite face of the tab. The depth of said indentation preferably approximates the thickness of the base sheet 15.

Die tooling is used to strike tab 30 in such a way that the proximal portion of the tab, which is integrally formed with the sheet, joins the plane of sheet 15 in a zone of merger having peculiar geometry and, more specifically, providing a protuberance 32 of compound curvature. In plan, protuberance 32 is of approximately semicircular convex configuration, the curvature extending in the opposite direction from the tab. The protuberance is provided with a shoulder 33 which slopes rather gradually into the face 11 of sheet 15. The width or chord of protuberance 32 is less than that of the tab, defining short, relatively straight-edged shoulders **34*a*, 34*b* on opposite sides of protuberance 32. These shoulders slope more steeply than shoulder 33 into face 11**.

The foregoing arrangement provides an extraordinarily resilient, strong clip which, by resiliently bearing against the insert sheet material, not only tightly and reliably grippingly engages margins of the insert, such as that at 21, but also provides for a nonlinear, stress-reducing, distribution of binding forces imposed on the clip by bending of its tab portion 30, distributing these bending forces nonlinearly into the base sheet 15 in a manner avoiding fatigue-producing flexion along a single line, which flexion would be conducive to eventual breakage of tab 30 at its proximal end. Further, the arrangements of shoulders **34*a*, 34*b* on opposite sides of protuberance 32 provides increased strength as well as avoidance of any tendancy for cracks to form incipiently at the proximal side edges of the tab, i.e., terminus of portions 29*b*, 29*c*** of the tab line of separation, which cracks might propagate into the sheet along the securement of the tab.

It will be observed in FIG. 2 that the chord of protuberance 32 and shoulders **34*a*, 34*b* define a line 36 of demarcation representing the position of an insert edge when such insert is as deeply seated as possible under tab 30. Dimples 27 are each located within such line of demarcation, i.e., so as to be within the margin of an overlying insert when the same is being retained by clip 21. However, the protrusion 31' defined by notch 31 is located upon tab 30 more distal than a line passing through the centers of dimples 27. In this way the dimples 27 and protrusion 31' coact to cause bending of the margin of the insert not only about an axis parallel to that of protrusion 31'** but also within a small region between the dimples about the axis of symmetry of the tab.

As more clearly seen in FIGS. 3 and 4, there is thus provided a compound curvature of the margin of an insert in a small region within the vicinity of each clip, as well as under each clip tab 30. Resultant deformation or curvature of the insert, as indicated at 37, greatly enhances the gripping engagement of the insert margins by the clips.

The inserts may be of various materials exhibiting a degree of resilience whereby the above-described deformation permits enhanced forces of retention to be developed relative to the planes of the insert or base sheet. For this purpose, sheet material, various synthetic resins or so-called plastics are preferably employed such as, for example, ABS. Various insert thicknesses are possible but a very satisfactory thickness for ABS has been 0.030 inch, and with said base sheet 15 being of aluminum alloy of thickness such as from about 0.030 to about 0.040 inch. Other insert materials which may be used include, without limiting the possible materials, sheets of various metals, fiberglass sheet composites, and cardboard.

Referring to FIG. 1, the clips of rows 19 and 21 which open onto a given face of the base sheet 15 may advantageously be mutually staggered whereby an insert 12, as shown, is gripping engaged by the slips in horizontally staggered manner.

Due to the multiplicity of the various clips, inserts of various widths may be readily accommodated. For example, each insert may have just one or a few digits thereon, as for fuel price signs, being thus readily replaceable with other inserts having different digits thereon to indicate a different price, or, as a further example, inserts carrying digits indicating a price may be replaced by a large insert containing a message such as "OUT OF GAS," "TIRE SALE TODAY," etc.

Figure 5:
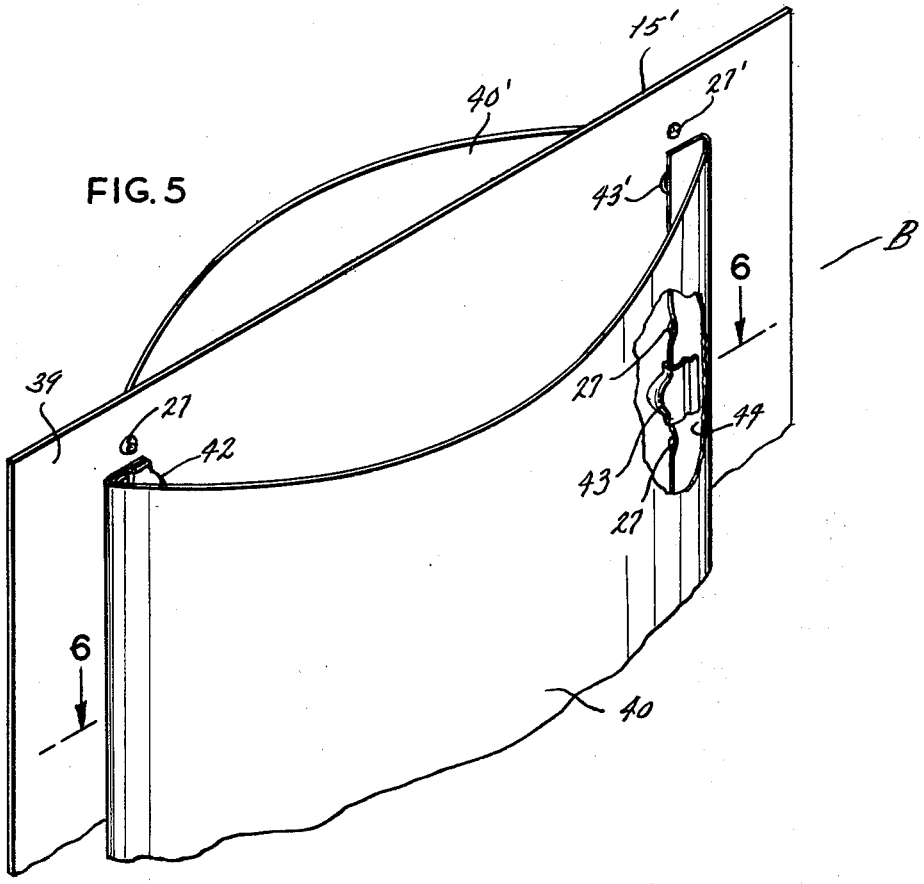
FIG. 5 is a perspective view of portions of further embodiment of the new sign of the invention.
Figure 6:
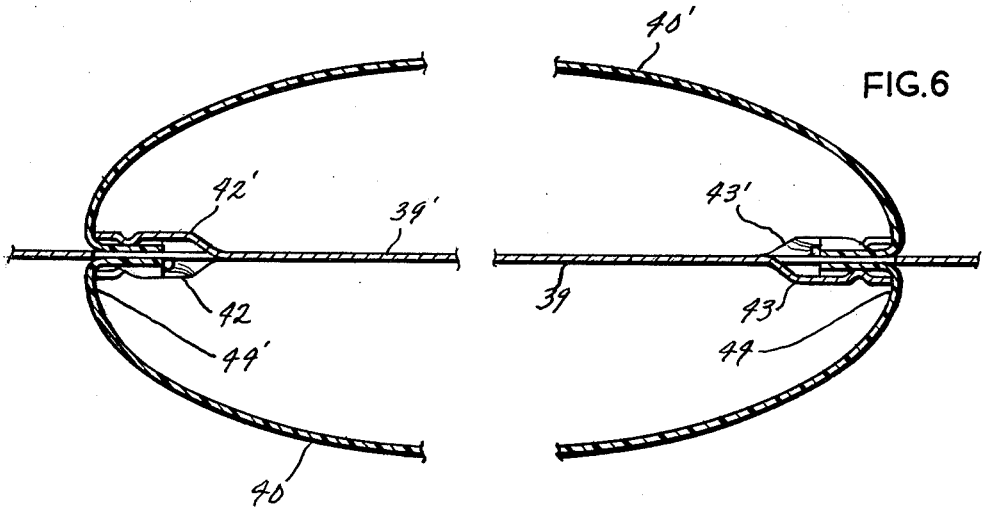
FIG. 6 is a horizontal transverse cross-section of the sign of FIG. 5, taken along line 6—6 of FIG. 5.

Signs of the invention provide many display capabilities which have not been satisfactorily manifested heretofore. Referring to FIGS. 5 and 6, there is illustrated at B an embodiment of the new sign demonstrating a most useful display capability. There, a base sheet 15' is provided having opposite faces 39, 39' with respective inserts 40, 40' which are constituted by curved sheets of material to provide a nonplanar display surface suggestive of a cylindrical surface. There are many uses for a curved display surface such as where it is desired to simulate the appearance of an object having a rounded character. For example, for signs to be employed by car service stations, it may be desired to display a picture of a shock absorber or can of oil. Such curved inserts 40, 40′ effectively simulate the shape and character of such objects. Additionally, there are many display possibilities where prominence, emphasis or other attributes of a curved display surface will enhance noticeability of the sign or make portions of the display more readable from positions at an unusual angle relative to the face of the sign.

For this purpose, sign B is provided with at least a pair of clips 42, 43 of the previously described configuration but opening in opposite directions. More preferably, such clips are staggered, as before, in parallel rows, and alternating with clips 42′, 43′ which opens onto rear face 39′. Also, there are provided on opposite sides of each clip dimples 27, as in sign A for causing the insert material to be deponent for more positive, secure engagement.

Each of inserts 40, 40′ is sized to provide width, i.e., the surface dimension spacewise of the insert sheet between clips, so that a portion of the insert sheet can be bent sharply back toward each other, as indicated at 44, 44′, to provide marginal portions clampably engaged by the clips.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed and desired to be secured by Letters Patent is:

1. A sign for carrying changeable inserts, said sign comprising a metal base plate of resilient materials, a plurality of clips formed in said base plate for gripping engagement of an insert of sheet material to carry said insert upon a surface of said base plate, characterized by said clips each comprising a tab integrally formed with said base plate and extending above said surface and opening onto said surface, said tab resiliently bearing against portions of said insert sheet material for gripping engagement of said insert, said tab being joined to said base plate by a zone of merger having compound curvature for nonlinear distribution of bending forces upon bending, of said tab, said base sheet comprising first and second circular protrusions located on opposite sides of each said tab for coacting with said tab to deform the margin of said insert sheet material for more secure engagement thereof.

2. A sign according to claim 1 and further characterized by said protrusions being constituted by dimples of said base sheet closely proximate side edges of said tab.

3. A sign according to claim 1 and further characterized by said tab having a groove formed in a top surface thereof and creating a corresponding protrusion on a bottom surface of said tab.

4. A sign according to claim 1 and further characterized by said tab being formed by a line of separation in said base plate, said line of separation being of foreshortened U-shape.

5. A sign according to claim 1 and further characterized by said curvature of said zone of merger extending generally rearwardly from said tab.

6. A sign according to claim 5 and further characterized by said zone of merger being defined by a protrusion having a generally semicircular shape in plan.

7. A sign according to claim 6 and further characterized by said generally semicircular protrusion having a chord extending along a proximal portion of said tab defining its base, said chord being substantially less than the width of said base.

8. A sign according to claim 7 and further characterized by said generally semicircular protrusion defining a shoulder which slopes into the surface of said base plate, said tab defining side shoulders on opposite sides of the last-said protrusion, said side shoulders sloping into the surface of said base plate more steeply than the first-said shoulder.

9. A sign for carrying changeable inserts, said sign comprising a metal base plate of resilient materials, a plurality of clips formed in said base plate for gripping engagement of an insert of sheet material to carry said insert upon a surface of said base plate, characterized by said clips each comprising a tab integrally formed with said base plate and extending above said surface and opening onto said surface, said tab resiliently bearing against portions of said insert sheet material for gripping engagement of said insert, said tab being joined to said base plate by a zone of merger having compound curvature for nonlinear distribution of bending forces upon bending, of said tab, said clips being oriented in parallel rows on said base plate, with the clips in one row being in staggered relationship with the clips of the other row, the tabs of said clips alternately opening into front and rear surfaces of said base plate.

10. A sign for carrying changeable inserts, said sign comprising a metal base plate of resilient materials, a plurality of clips formed in said base plate for gripping engagement of an insert of sheet material to carry said insert upon a surface of said base plate, characterized by said clips each comprising a tab integrally formed with said base plate and extending above said surface and opening onto said surface, said tab resiliently bearing against portions of said insert sheet material for gripping engagement of said insert, said tab being joined to said base plate by a zone of merger having compound curvature for nonlinear distribution of bending forces upon bending, of said tab, said clips being at least two in number and with tabs thereof opening in opposite directions, said insert being of sheet material providing opposite side edges redirected toward each other to form a curved display surface upon said sheet material, the tabs of said clips providing gripping engagement of marginal portions of said side edges to maintain the curvature of said display surface.

* * * * *